United States Patent [19]

Kruczynski

[11] 4,252,136

[45] Feb. 24, 1981

[54] ERECTABLE-COLLAPSIBLE ENCLOSURE STRUCTURE

[76] Inventor: Anthony Kruczynski, Rte. #2, Box 98, Posen, Mich. 49776

[21] Appl. No.: 8,068

[22] Filed: Jan. 31, 1979

[51] Int. Cl.[3] ..... A45F 1/00

[52] U.S. Cl. ..... 135/1 R

[58] Field of Search ..... 135/1 R, 1 A

[56] References Cited

U.S. PATENT DOCUMENTS

| | | | |
|---|---|---|---|
| 2,887,234 | 5/1959 | Huey et al. | 135/1 R X |
| 2,891,562 | 6/1959 | Kruczynski | 135/1 R |
| 3,288,520 | 11/1966 | Krutzikowsky | 135/1 A |
| 3,351,078 | 11/1967 | Kleiman | 135/1 A |

*Primary Examiner*—J. Karl Bell

*Attorney, Agent, or Firm*—William T. Sevald

[57] ABSTRACT

An erectable-collapsible enclosure structure having a top frame over which a flexible tent is draped leading to a bottom support to which the tent is attached. Two sets of upper and lower legs are pivotally connected at one end to the top frame and bottom support respectively and are pivotally connected to one another at their extending ends in a bent knee joint. The knee joints of each set lie on the opposite side of the knee joint of the other set so that the legs by-bass one another adjacent the knee joints. The top frame is manually raisable and lowerable relative to the bottom support to erect and collapse the structure. A pin placed between the upper and/or lower legs at their point of cross-over rigidly locks the structure in its erected position. Springs may be connected to the legs to assist in raising the enclosure and for holding it in its erected position. Hand levers connected to the bottom legs provide added means to operate the apparatus. The bottom support may be a sled for ice fishing, for hunting, a trailer, a pick-up truck, floor, etc. for camping.

4 Claims, 6 Drawing Figures

ERECTABLE-COLLAPSIBLE ENCLOSURE STRUCTURE

BACKGROUND OF THE INVENTION

Enclosures for ice fishing, travel, camping, hunting and other uses are highly desirable and in demand. However, most are heavy, expensive and cumbersome to handle, transport, use and store. None of the prior art devices are multi-purpose and easily transferred from one thing to another to permit a different use and mode of transportation. None of the prior art devices have simple means to rigidly lock the structure in its erected position.

SUMMARY OF THE PRESENT INVENTION

The erectable-collapsible enclosure structure of the invention has a top frame over which a flexible tent-like member is draped and which leads down to a bottom support which may be an ice-fishing sled, a hunting sled or wagon, a pick-up or other truck for travel, a trailer, a floor . . . etc.

Two sets of upper and lower legs are pivotally connected at one end to the top frame and bottom support respectively on either side of the enclosure and are pivotally connected to one another at their extending ends in a bent knee joint centrally of the enclosure about mid-way between top and bottom.

The knee joints of each set on either side of the structure lie on the opposite side of the knee joint of the other set relative to the pivot points of the legs so that the upper legs by-pass one another adjacent the knee joints and the lower legs by-pass one another adjacent the knee joints.

From a collapsed position, the top frame and tent are raisable manually above the bottom support via the pivoting of the sets of legs and knee joints to an erected position which raises the flexible tent. From an erected position, the top frame and tent are lowerable manually or by gravity to the collapsed position via pivoting the sets of legs and knee joints which allows the tent to fold down on the bottom support.

In the erected position, a pin is inserted between the crossed-over upper and/or lower legs of the sets of legs on either side of the structure forming a triangle between the pin and the pivot points of the upper and/or lower legs thereby locking the structure in the erected position. Springs may be connected between the top frame and/or lower support and the legs pivotally mounted thereon to urge the enclosure toward its erected position and the springs assist in the manual raising and are stretched out in the manual collapsing so as to be loaded to assist in subsequent erection.

It is important to note that when the upper and/or lower legs are pinned together that the top inflexible triangular structure supports the top frame and tent with trussed girder stability and that the legs are supported on the bottom support with trussed girder stability giving the otherwise collapsible structure the strength, rigidity, and dependability of a non-collapsible structure. This prevents wobbling, corner, side and/or end drop-down from a full erected position, and provides adequate resistance to snow loading, clothes and/or equipment being hung on the inside and/or outside of the structure, and sagging from wind, rain, and/or long periods in the erected position.

It is also important to note that with the knee joints on opposite sides relative to the pivot points of the interconnected upper and lower legs of the knee joint, that the legs pivot and lie within the dimensions of the structure in the collapsed and erected positions.

Hand levers are connected to the bottom legs of each set on either side of the structure to provide the user with ready means to manually move the structure between its erected and collapsed positions.

The tent and bottom legs may be removably connected to the bottom support so that the structure may be transferred between sleds, wagons, trucks, trailers, floors, etc., enabling the user to use the same enclosure structure in multiple modes by connecting the bottom legs and tent to a different bottom support and/or connecting the bottom support to a different means of transportation.

The enclosure structure is easily mounted on any type bottom support and/or vehicle as will be understood from the detailed description of the illustrated embodiment showing an exemplary sled mounting taken in connection with the accompanying drawings now described.

DETAILED DESCRIPTION OF THE ILLUSTRATED EMBODIMENT

Figure 4:
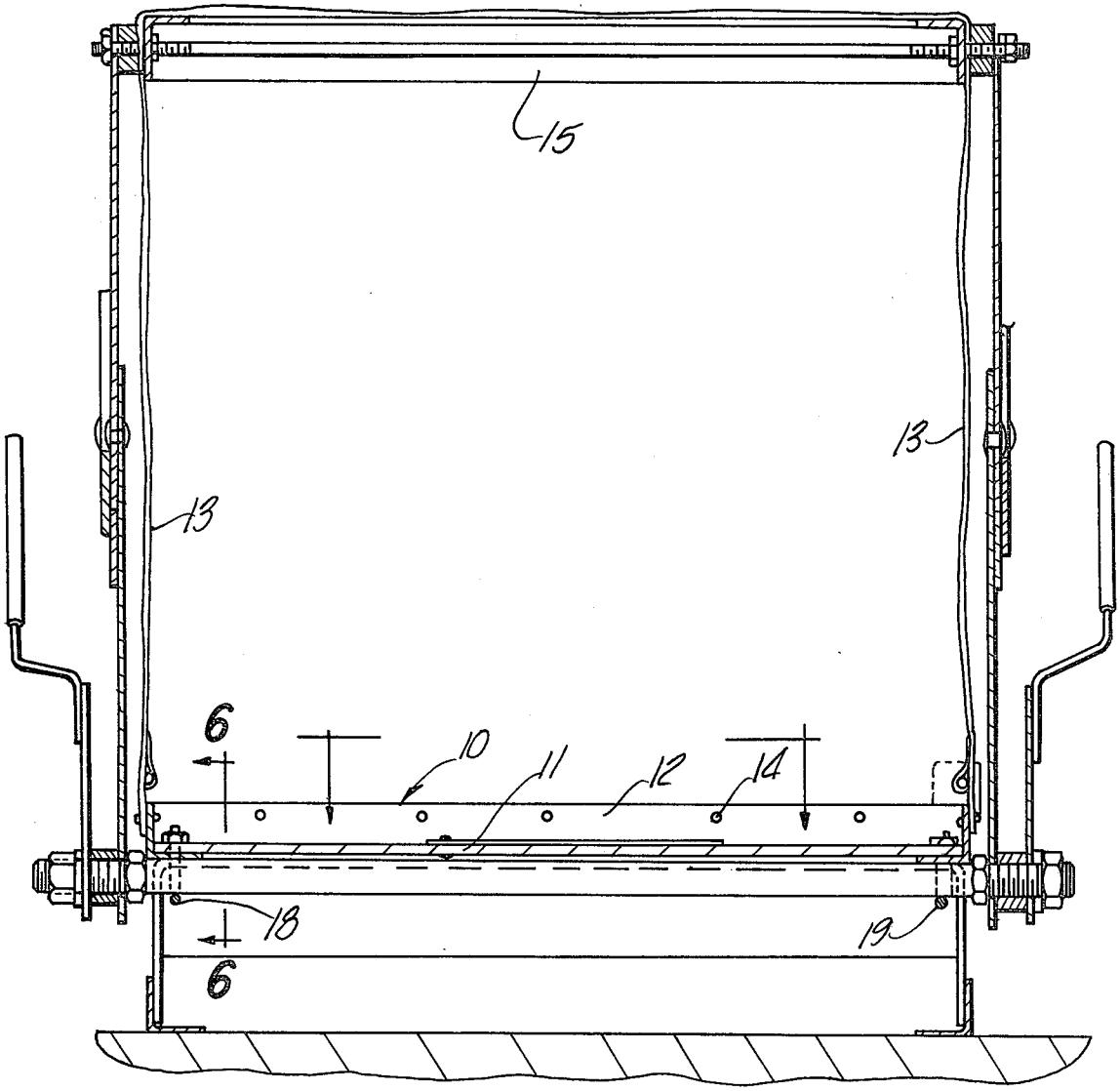
FIG. 4 is an enlarged cross-sectional view of the apparatus shown in FIG. 2 taken on the line 4—4 thereof showing more detail of the structure.
Figure 5:
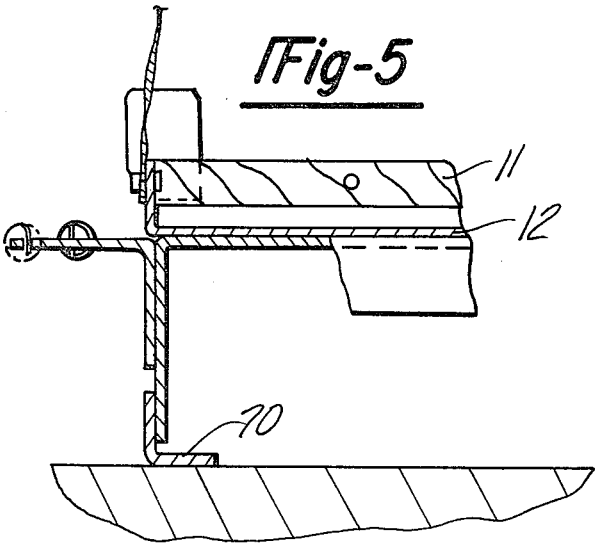
FIG. 5 is an enlarged partial cross-sectional view of the apparatus as seen in FIG. 4, with portions broken away, showing the integration of tent and bottom support floor and the spring flanges.
Figure 6:
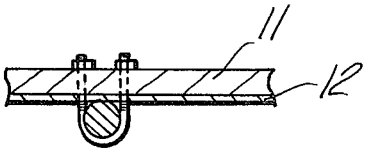
FIG. 6 is a partial cross-sectional view of the apparatus of FIG. 4, taken on the line 6—6 thereof, with parts broken away, showing lower pivot means for the lower legs.

Referring now to the drawings wherein like reference numerals refer to like and corresponding parts throughout the several views, the novel erectable-collapsible enclosure structure disclosed therein to illustrate an exemplary embodiment of the invention, comprises a bottom support 10 consisting of a floor 11 and an upstanding peripheral bottom flange 12 constituting side members and end members, FIG. 4. A tent 13 is attached to the flange 12 by fasteners 14 and consists of a roof, side walls and end walls. A peripheral top frame 15 consisting of side rails and end rails fits inside the tent 13 at the top.

Paired spaced pivot bolts 16 and 17 are mounted on the bottom support 10 by freely fitting U-bolts 18 and 19 to provide bottom pivot means. Paired spaced pivot bolts 20 and 21 are mounted on the top frame 15 to provide top pivot means. Stub shafts attached to the bottom support 10 and to the top frame 15 may be substituted for the bolts 16–17 and 20–21 and all may be rotatably or non-rotatably mounted.

A pair of lower legs 30 and 31 have bottom ends 32 and 33 pivotally swung on the bolts 16 and 17 on both sides of the apparatus. A pair of upper legs 34 and 35 have top ends 36 and 37 pivotally swung on the bolts 20 and 21 on both sides of the apparatus.

The lower legs 30–31 incline upwardly toward one another and terminate in crossed-over projecting ends 40 and 41. The upper legs 34–35 incline downwardly toward one another and terminate in crossed-over projecting ends 42 and 43. The projecting end 40 of lower leg 30 is pivotally connected to the projecting end 42 of upper leg 34 by a rivet or pin 44. The projecting end 41 of lower leg 31 is pivotally connected to the projecting end 43 of upper leg 35 by a rivet or pin 45. The pins 44 and 45 constitute knee joints between the lower legs 30–31 and the upper legs 34, 35 respectively. The thus connected upper and lower legs constitute a set of legs. It is important to note that the knee joints 44, 45 lie on the opposite side of one another relative to the lower and upper pivot points 16, 20 of one set of legs and the lower and upper pivot points 17, 21 of the other set of legs. Like sets of legs are on both sides of the apparatus.

A lock bolt or pin 50 interconnects the upper legs 34, 35 in their cross-over area adjacent their projecting ends 42, 43 in the erected position of the apparatus inflexibly joining them in a locked triangle support truss fixedly holding the apparatus in its erected position. A lock bolt or pin 51 interconnects the lower legs 30, 31 with like effect. Either one or both pins 50, 51 may be used to effect the erected position. Like pins 50, 51 are on both sides of the apparatus.

Figure 1:
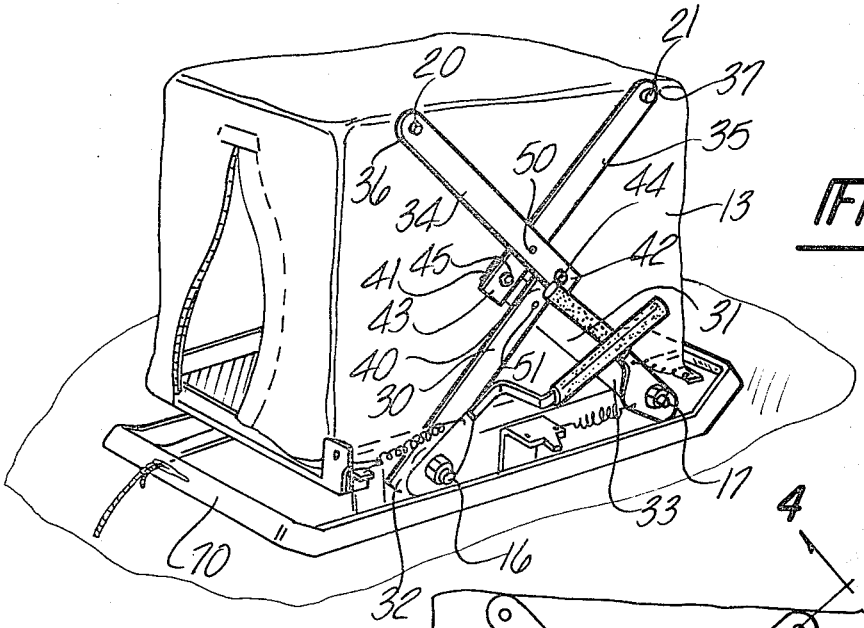
FIG. 1 is a perspective view of the erectable-collapsible enclosure structure in the erected position showing the top, one end, and one side with the bottom support shown as a floor on a sled for ice fishing, hunting or camping.
Figure 2:
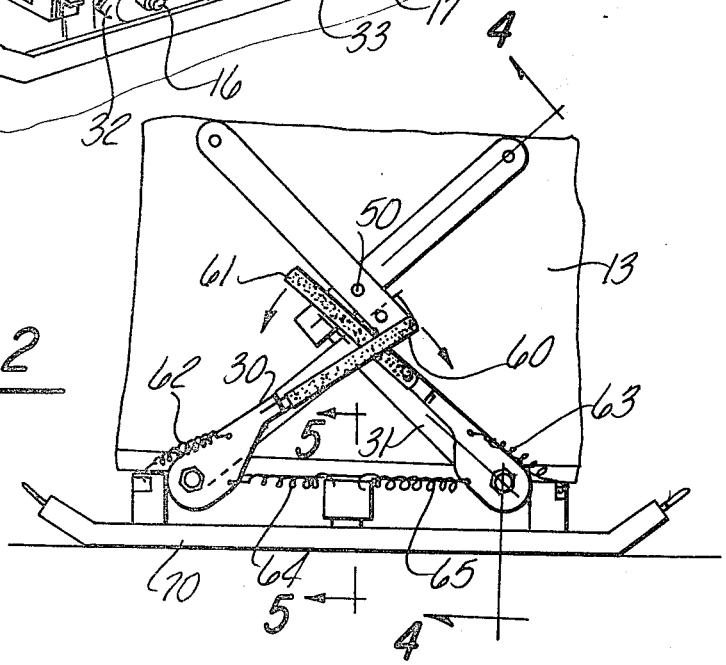
FIG. 2 is a side elevational view of the apparatus as seen in FIG. 1.
Figure 3:
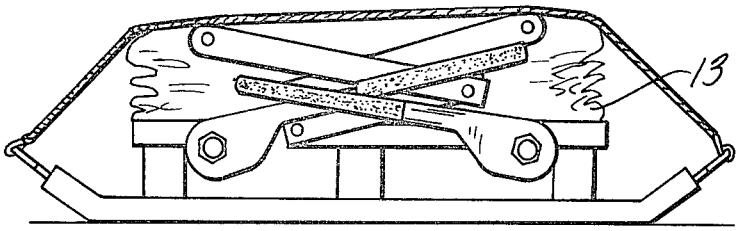
FIG. 3 is a side elevational view of the apparatus of FIGS. 1 and 2 shown in the collapsed position.

Upon removal of the pins 50 and/or 51 on both sides of the apparatus, it collapses from the erected position seen in FIGS. 1, 2 and 4 to its collapsed position seen in FIG. 3 as the knee joints 44, 45 and the pivotally mounted top ends 36, 37 of the upper legs 34, 35 and the pivotally mounted bottom ends 32, 33 of the bottom legs 30, 31 are freely integrated. The knee joints 44, 45 move outwardly in the collapsing movement thus locating the sets of legs within the extent of the apparatus thereby eliminating projections.

To erect the apparatus from the collapsed position of FIG. 3 to the erected position of FIGS. 1, 2 and 4, the user lifts the top frame 15 upwardly, swings the sets of legs, and/or forces the knee joints 44 toward one another and inserts the lock pins 50 and/or 51 on both sides of the apparatus.

Hand levers 60 and 61 may be attached to the lower legs 30, 31 to aid in swinging the sets of legs between their collapsed and erected positions. Springs 62 and 64 resiliently upwardly bias the lower leg 30 and springs 63 and 65 resiliently upwardly bias the lower leg 31. This bias is transferred to the upper legs 34 and 35 via the knee joints 44 and 45. The springs aid the user in erecting the apparatus and inserting the lock pins 50 and 51. The levers and/or springs are integrated on both sides of the apparatus.

A sled 70 transportably supports the apparatus as shown. This is shown by way of illustration as the apparatus may be set on the ground, mounted on a trailer, truck or wagon as desired.

While a single embodiment of the invention has been shown and described in detail, it is to be understood that modification of the exact structure may be made within the purview of the invention and that the claims define the protective scope of the invention.

I claim:

1. An erectable-collapsible enclosure structure suitable for mounting on a floor, truck, trailer, sled and the like, comprising, a top frame including side rails and end rails, a bottom support including side members and end members, a flexible tent having a roof, side walls and end walls; said roof, side walls and end walls being interconnected;

said tent roof lies over said top frame and said side walls and end walls depend from said roof and are connected to said bottom support;

paired upper legs lie outside of said tent; are spaced from one another; and have upper ends pivotally connected through said tent to said side rails on both said side(s) rails of said top frame; at points spaced inwardly from said end rails said upper legs extend downwardly, incline toward and cross one another, and terminate in outer ends;

paired lower legs lie outside of said tent; are spaced from one another; and have lower ends pivotally connected through said tent to said side members on both side(s) members of said bottom support; at points spaced inwardly from said end members said lower legs extend upwardly, incline toward and cross one another, and terminate in outer ends;

each said upper leg (overlying) is paired with one said lower leg as a set of legs, with their outer ends overlying one another;

each said overlying set of upper and lower legs are pivotally interconnected at their said outer ends in a bent knee joint;

said bent knee joints at each said set of paired legs on both sides of said structure extend past one another at said bent knee joints and lie in positions on the opposite side of one another from the location of their said leg pivot points of said paired upper and lower legs on said top frame and said bottom support respectively;

said bent knee joints on either side of said structure move toward one another so as to lie adjacent one another in the erected position to extend said sets of legs vertically to effect the erected position of said structure;

said bent knee joints on either side of said structure move away from one another so as to lie remote to one another in the collapsed position to extend said sets of legs horizontally to effect the collapsed position of said structure;

said knee joints and said sets of legs being movable between the erected and collapsed positions to erect and collapse said enclosure structure.

2. In apparatus as set forth in claim 1, at least one pin interconnecting one said upper and lower legs on either side of said structure in the area where they cross one another locking said legs in a triangle between said pin and said pivot points of said legs to (lock) secure said structure in its erected position.

3. In apparatus as set forth in claim 1, at least one pair of springs connected to (one said upper and) said lower legs on either side of said structure urging said legs to their erected position to (hold) urge said structure (in) to its erected position and to assist in raising said legs to their erected position.

4. In apparatus as set forth in claim 1, paired levers connected to said paired lower legs constituting handles for moving said sets of legs between their erected and collapsed positions.

* * * * *